US011933540B2

(12) United States Patent
Tuo et al.

(10) Patent No.: US 11,933,540 B2
(45) **Date of Patent: *Mar. 19, 2024**

(54) DUAL COLUMN NITROGEN PRODUCING AIR SEPARATION UNIT WITH SPLIT KETTLE REBOIL AND INTEGRATED CONDENSER-REBOILER

(71) Applicants: Hanfei Tuo, East Amherst, NY (US); Zhengrong Xu, East Amherst, NY (US)

(72) Inventors: Hanfei Tuo, East Amherst, NY (US); Zhengrong Xu, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/300,033

(22) Filed: Apr. 13, 2023

(65) Prior Publication Data

US 2023/0251033 A1 Aug. 10, 2023

Related U.S. Application Data

(63) Continuation of application No. 17/234,080, filed on Apr. 19, 2021, now Pat. No. 11,674,750.
(Continued)

(51) Int. Cl.

| | |
|---|---|
| ***F25J 3/02*** | (2006.01) |
| ***F25J 3/04*** | (2006.01) |
| *F25J 1/00* | (2006.01) |

(52) U.S. Cl.
CPC ..... *F25J 3/04412* (2013.01); *F25J 3/0257* (2013.01); *F25J 3/04012* (2013.01);
(Continued)

(58) Field of Classification Search
CPC .. F25J 3/04412; F25J 3/04484; F25J 3/04012; F25J 3/04763; F25J 2290/30
See application file for complete search history.

(56) References Cited

U.S. PATENT DOCUMENTS

| | | | |
|---|---|---|---|
| 3,264,830 | A | 8/1966 | Smith |
| 4,453,957 | A | 6/1984 | Pahade et al. |

(Continued)

FOREIGN PATENT DOCUMENTS

| | | | |
|---|---|---|---|
| EP | 0770841 | A2 | 5/1997 |
| EP | 2015013 | A2 | 1/2009 |

(Continued)

*Primary Examiner* — Brian M King
(74) *Attorney, Agent, or Firm* — Robert J. Hampsch

(57) ABSTRACT

Enhancements to a dual column, nitrogen producing cryogenic air separation unit are provided. Such enhancements include an improved air separation cycle that uses multiple condenser-reboilers and recycles a portion of the vapor from one or more of the condenser-reboilers to the incoming feed stream and or the compressed purified air streams to yield improvements in such dual column, nitrogen producing cryogenic air separation units. The multiple condenser-reboilers preferably include an integrated condenser-reboiler arrangement comprising a heat exchanger having a set of nitrogen condensing passages, a first set and second set of boiling passages, and a phase separator.

11 Claims, 2 Drawing Sheets

Related U.S. Application Data

(60) Provisional application No. 63/034,433, filed on Jun. 4, 2020.

(52) U.S. Cl.
CPC ..... *F25J 3/04763* (2013.01); *F25J 1/0012* (2013.01); *F25J 2200/50* (2013.01); *F25J 2210/40* (2013.01); *F25J 2250/20* (2013.01)

(56) References Cited

U.S. PATENT DOCUMENTS

| | | | | |
|---|---|---|---|---|
| 5,098,457 | A | 3/1992 | Cheung et al. | |
| 5,170,630 | A | 12/1992 | Stern | |
| 6,257,019 | B1 | 7/2001 | Oakey et al. | |
| 6,330,812 | B2 | 12/2001 | Mostello | |
| 2017/0227284 | A1* | 8/2017 | Egoshi ..... | F25J 3/04212 |

FOREIGN PATENT DOCUMENTS

| | | | |
|---|---|---|---|
| EP | 2463232 | A1 | 6/2012 |
| JP | 2001336876 | A | 12/2001 |
| JP | 2013061109 | A | 4/2013 |

* cited by examiner

DUAL COLUMN NITROGEN PRODUCING AIR SEPARATION UNIT WITH SPLIT KETTLE REBOIL AND INTEGRATED CONDENSER-REBOILER

CROSS REFERENCE TO RELATED APPLICATIONS

This continuation application claims the benefit of and priority to U.S. patent application Ser. No. 17/234,080 filed Apr. 19, 2021 which claims the benefit of and priority to U.S. provisional patent application Ser. No. 63/034,433 filed Jun. 4, 2020, the disclosures of which are incorporated by reference herein.

TECHNICAL FIELD

The present inventions relate to enhancements to a dual column, nitrogen producing cryogenic air separation unit, and more particularly to improvements in the performance of such dual column, nitrogen producing air separation units. The performance improvements are generally attributable to an enhanced air separation cycle that uses multiple condenser-reboilers and recycles a portion of the vapor from one or more of the condenser-reboilers to the incoming feed stream and or the compressed, purified air streams. The multiple condenser-reboilers preferably include an integrated condenser-reboiler arrangement.

BACKGROUND

Industrial gas customers often seek nitrogen product slates at volumes and pressures that typically require very large cryogenic air separation units. Such large scale or high volume nitrogen producing air separation units often use a dual distillation column arrangement, including a higher pressure column and a lower pressure column in which gaseous nitrogen products are withdrawn from the distillation columns at relatively high pressures or at two different pressures. In the conventional dual column nitrogen producing air separation unit, the higher pressure column and lower pressure column are thermally linked in a heat transfer relationship by a main condenser, which liquefies a portion of the nitrogen-enriched vapor from the overhead of the higher pressure column to be used as reflux to the higher pressure column. Supplemental refrigeration for such conventional nitrogen producing air separation cycles is typically provided via an upper column turbine arrangement. An example of a large volume nitrogen producing air separation unit is disclosed in U.S. Pat. No. 4,453,957. Over the course of the past several decades numerous improvements to such large volume nitrogen producing cryogenic air separation units have been developed to address shortcomings in the performance of such large-scale nitrogen producing air separation cycles.

For example, U.S. Pat. No. 5,098,457 discloses a double distillation column arrangement for large volume nitrogen production where the main condenser is not driven by reboiling a portion of the lower pressure bottoms liquid, but rather the main condenser is driven by a portion of the kettle liquid from the higher pressure column. More specifically, U.S. Pat. No. 5,098,457 discloses a split kettle arrangement wherein a portion of the kettle liquid from the higher pressure column is re-boiled in the main condenser and another portion of the kettle liquid from the higher pressure column is directed to an intermediate location on the lower pressure column.

U.S. Pat. No. 6,330,812 discloses another double distillation column arrangement for large volume nitrogen production that employs three condenser-reboilers including a double main condenser configuration where both main condensers are driven by reboiling kettle liquid from the higher pressure column while the third condenser-reboiler associated with the lower pressure column is driven by the oxygen-enriched liquid taken from the bottom of the lower pressure column.

Finally, U.S. Pat. No. 6,257,019 discloses a triple distillation column arrangement for large volume nitrogen production. In addition to the conventional lower pressure distillation column and higher pressure distillation column each with a separate condenser-reboiler, the triple distillation column arrangement also utilizes an intermediate pressure distillation column and a third condenser operatively associated with the intermediate pressure distillation column. The triple distillation column arrangement is believed to demonstrate very high nitrogen recoveries at comparatively lower power consumption levels. However, a key disadvantage to the triple distillation column arrangement is the higher capital costs associated with the additional column, the third condenser/reboiler, and additional compressors needed for the intermediate pressure column feed.

Other improvements to such large volume nitrogen producing air separation units have been employed in applications requiring a portion of the nitrogen to be provided as liquid nitrogen. In applications where is no need or desire to make a liquid nitrogen product from the air separation unit, the upper column turbine arrangement disclosed in U.S. Pat. No. 4,453,957 is adequate. However, in end-user applications where a liquid nitrogen product is required or desired, employing the conventional upper column turbine arrangement is economically impractical, as the arrangement leads to high liquefaction unit power costs and unworkable rangeability requirements. Such previous improvements included arrangements that employ a lower column turbine arrangement, a waste gas expansion arrangement, a nitrogen product expansion and recycle arrangement, and a warm recycle turbine refrigeration arrangement.

What is needed are further enhancements to such large-scale nitrogen producing cryogenic air separation units to improve nitrogen recovery and/or reduce the associated operating costs (i.e. power costs) and capital costs over the above-identified prior art systems and previously disclosed improvements thereto.

SUMMARY OF THE INVENTION

The present invention may be characterized as an integrated condenser-reboiler arrangement for a distillation column system comprising a phase separator and a once-through condenser-reboiler that is either disposed in or in fluid communication with the phase separator. The once-through condenser-reboiler comprises: (i) a top section, (ii) an intermediate location, and (iii) a bottom section, (iv) a plurality of condensing passages configured to receive a gaseous stream from the distillation column system at the top section of the once-through condenser-reboiler and condense the gaseous stream traversing through the plurality of condensing passages via indirect heat exchange with a first kettle stream and a second kettle stream to yield a condensate that exits the bottom section of the once-through condenser-reboiler; (v) a first set of boiling passages configured to receive the first kettle stream from the distillation column system at the bottom section of the once-through condenser-reboiler and partially vaporize the first condensing stream via indirect heat exchange with the gaseous stream traversing through the cooling passages to yield a dual phase boil off stream, and wherein the dual phase boil off stream is released from the top section of the once-through condenser-reboiler into the phase separator; and (vi) a second set of boiling passages configured to receive the second condensing medium from the phase separator at an intermediate location on the once-through condenser-reboiler and vaporize or partially vaporize the second condensing medium to yield another boil off stream that exits the top section of the once-through condenser-reboiler and directed back to the distillation column system. The phase separator is configured to separate the dual phase boil off stream into the second condensing medium and a recycle vapor stream.

The integrated condenser-reboiler arrangement is particularly suited for use in an air separation unit that includes: (a) a main air compression system configured for receiving a stream of incoming feed air and producing a compressed air stream; (b) an adsorption based pre-purifier unit configured for removing impurities from the compressed air stream and producing a compressed, purified air stream; (c) a main heat exchange system configured to cool the compressed and purified air stream to temperatures suitable for fractional distillation; and (d) a distillation column system comprises a higher pressure column and a lower pressure column linked in a heat transfer relationship via multiple condenser-reboilers including an integrated condenser-reboiler arrangement. The distillation column system produces a lower pressure nitrogen product stream, a high pressure nitrogen product stream, a waste stream and a recycle stream that is a portion of the vapor from one or more of the condenser-reboilers that is recycled to the incoming feed air stream and or the compressed, purified air stream.

The higher pressure column is configured to receive the cooled, compressed, purified air stream and produce a nitrogen enriched overhead and an oxygen-enriched kettle stream while the lower pressure column is configured and produce a lower pressure nitrogen product stream, an overhead stream and an oxygen-enriched bottoms. The integrated condenser-reboiler arrangement is preferably configured to condense a portion of the nitrogen enriched overhead from higher pressure column against a kettle stream from the higher pressure column to produce a liquid nitrogen stream, the dual phase boil-off stream and another vaporized boil-off stream.

A third condenser-reboiler is operatively associated with the lower pressure column and configured to condense the nitrogen overhead from the lower pressure column against the oxygen bottoms from the lower pressure column to produce a nitrogen reflux stream for the lower pressure column and a waste stream. In addition, another portion of the nitrogen enriched overhead from the higher pressure column may be taken as a high pressure nitrogen product stream.

BRIEF DESCRIPTION OF THE DRAWINGS

While the present invention concludes with claims distinctly pointing out the subject matter that Applicants regard as their invention, it may be better understood when taken in connection with the accompanying drawings in which:

DETAILED DESCRIPTION

As discussed in more detail below, the disclosed cryogenic air separation systems and methods provide certain performance enhancements to large-scale, dual column, nitrogen producing cryogenic air separation units targeted to increase nitrogen recovery and reduce power consumption compared to prior art large-scale, dual column, nitrogen producing cryogenic air separation units of the types disclosed in U.S. provisional patent application Ser. Nos. 63/029,909 and 63/029,915 filed on May 26, 2020, the disclosures of which are incorporated by reference herein.

Figure 1:
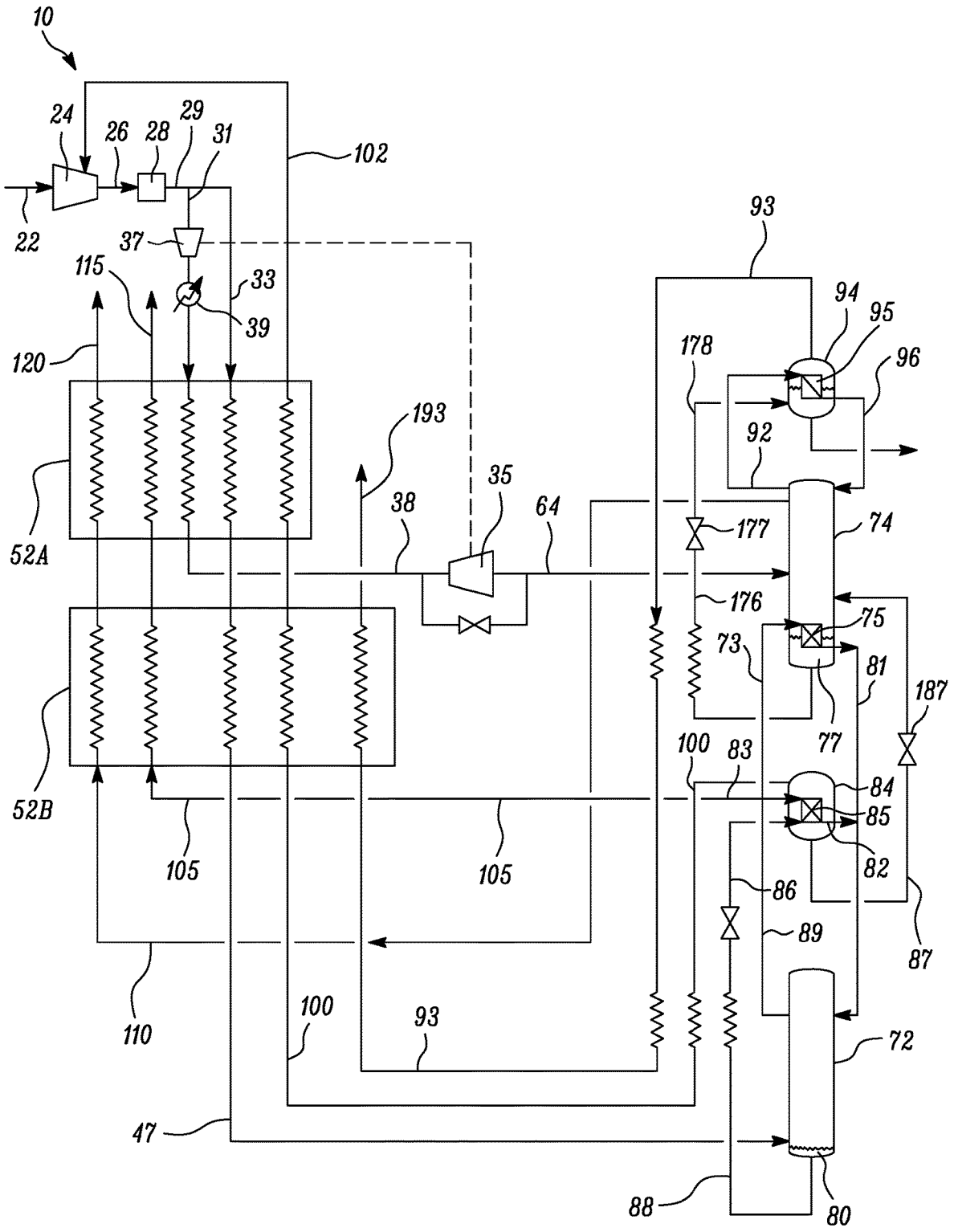
FIG. 1 is a schematic process flow diagram of an embodiment of a dual column, nitrogen producing cryogenic air separation unit having a plurality of condenser-reboilers, including two condenser-reboilers associated with the higher pressure column.

Turning to FIG. 1, there is shown a schematic illustration of a nitrogen producing cryogenic air separation unit 10 similar to those disclosed in U.S. provisional patent application Ser. Nos. 63/029,909 and 63/029,915. In a broad sense, the depicted air separation unit includes a main feed air compression train or system, a turbine air circuit, a main heat exchange system, and a distillation column system.

In the main feed compression train shown in FIG. 1, the incoming feed air 22 is typically drawn through an air suction filter house and is compressed in a multi-stage, intercooled main air compressor arrangement 24 to a pressure that can be between about 6.5 bar(a) and about 11 bar(a). This main air compressor arrangement 24 may include integrally geared compressor stages or a direct drive compressor stages, arranged in series or in parallel. The compressed air stream 26 exiting the main air compressor arrangement 24 is fed to a pre-purification unit 28 to remove impurities including high boiling contaminants. The pre-purification unit 28, as is well known in the art, typically contains two beds of alumina and/or molecular sieve operating in accordance with a temperature swing adsorption cycle in which moisture and other impurities, such as carbon dioxide, water vapor and hydrocarbons, are adsorbed. One or more additional layers of catalysts and adsorbents may be included in the pre-purification unit 28 to remove other impurities such as carbon monoxide, carbon dioxide and hydrogen to produce the compressed, purified air stream 29. Particulates may be removed from the feed air in a dust filter disposed upstream or downstream of the pre-purification unit 28.

As shown in FIG. 1, the compressed, purified air stream 29 may be split into a plurality of air streams, including a turbine air stream 31 and a compressed, purified feed air stream 33. Turbine air stream 31 may be further compressed in a turbine air booster compressor 37 and subsequently cooled in an aftercooler 39 to form a boosted pressure turbine air stream which is then partially directed to the main heat exchange system which includes heat exchanger 52A where it is partially cooled. The partially cooled, boosted pressure turbine air stream 38 exits heat exchanger 52A and is expanded in turbine 35 to produce exhaust stream 64 that is directed to lower pressure column 74. In this manner, a portion of the refrigeration for the air separation unit 10 is thus provided by the expansion of the turbine air stream 38 in turbine 35. The remaining portion of the compressed, purified feed air stream 33 is fully cooled in heat exchangers 52A and 52B and exits the cold end of heat exchanger 52B as a fully cooled air stream 47. The fully cooled air stream 47 is introduced into higher pressure column 72 at a location proximate the bottom of the higher pressure column 72.

Cooling the compressed, purified feed air stream 33 and partially cooling the boosted pressure turbine air stream in the heat exchangers 52A and 52B is preferably accomplished by way of indirect heat exchange with the warming streams which include the high pressure nitrogen product stream 105, the lower pressure nitrogen product stream 110 and a recycle stream 100 from the distillation column system to produce cooled air streams suitable for rectification in the distillation column system.

The heat exchangers 52A and 52B are preferably brazed aluminum plate-fin type heat exchangers. Such heat exchangers are advantageous due to their compact design, high heat transfer rates and their ability to process multiple streams. They are manufactured as fully brazed and welded pressure vessels. For larger air separation units handling higher flows, the heat exchanger may be constructed from several cores which must be generally connected in series as illustrated in the drawings.

The turbine based refrigeration circuit used in cryogenic air separation units are often referred to as either a lower column turbine (LCT) arrangement or an upper column turbine (UCT) arrangement which are used to provide refrigeration to a cryogenic air distillation column systems. In the UCT arrangement shown in FIG. 1, the boosted turbine air stream is preferably at a pressure in the range from between about 6 bar(a) to about 10.7 bar(a) and partially cooled to a temperature in a range of between about 140 K and about 220 K. This cooled, compressed turbine air stream that is introduced into the turbine to produce an expanded, cold exhaust stream 64 that is then introduced into the lower pressure column of the distillation column system. The supplemental refrigeration created by the expansion of the turbine air stream is thus imparted directly to the lower pressure column thereby alleviating some of the cooling duty of the main heat exchanger. In some embodiments, the turbine may be coupled with a compressor, either directly or by appropriate gearing.

While the turbine based refrigeration circuit illustrated in the FIG. 1 is shown as an upper column turbine (UCT) circuit where the turbine exhaust stream 64 is directed to the lower pressure column, it is contemplated that the turbine based refrigeration circuit alternatively may be a lower column turbine (LCT) circuit or a partial lower column (PLCT) where the expanded exhaust stream is fed to the higher pressure column of the distillation column system.

The illustrated distillation column system includes a higher pressure column 72, a lower pressure column 74, a first main condenser-reboiler 75, a second condenser-reboiler 85 and a third condenser-reboiler 95. The higher pressure column 72 typically operates in the range from between about 7 bar(a) to about 12 bar(a) whereas lower pressure column 74 operates at pressures between about 4.5 bar(a) to about 7 bar(a). Cooled feed air stream 47 is preferably a vapor air stream slightly above its dew point, although it may be at or slightly below its dew point, that is fed into the higher pressure column 72 for rectification resulting from mass transfer between an ascending vapor phase and a descending liquid phase that is initiated by a nitrogen based reflux stream. This separation process within the higher pressure column 72 produces a nitrogen-rich column overhead 89 and crude oxygen-enriched bottoms liquid also known as kettle liquid 80 which is taken as kettle stream 88.

The higher pressure column 72 and the lower pressure column 74 are preferably linked in a heat transfer relationship via the first main condenser-reboiler 75 wherein a first portion 73 of the nitrogen-rich vapor column overhead extracted from the higher pressure column 72 is condensed within the first main condenser-reboiler 75 shown as a once-through heat exchanger being located in the base of lower pressure column 74 against the oxygen-rich liquid column bottoms 77 residing in the bottom of the lower pressure column 74. The boiling of oxygen-rich liquid column bottoms 77 initiates the formation of an ascending vapor phase within lower pressure column 74. The condensation produces a liquid nitrogen stream 81 that is used to reflux the lower pressure column 74 to initiate the formation of descending liquid phase therein. If desired, a portion of the reflux stream may be withdrawn as liquid product.

A second portion 83 of the nitrogen-rich vapor column overhead extracted from the higher pressure column 72 is condensed within the second condenser-reboiler 85 shown as a once-through heat exchanger disposed in a separate condenser vessel 84. The second condenser-reboiler 85 is operatively associated with the higher pressure column 72 and configured to condense the second portion 83 of the nitrogen enriched overhead from the higher pressure column 72 against a subcooled first split portion 86 of the oxygen-enriched kettle stream 88 from the higher pressure column 72 to produce a liquid nitrogen stream 82 and a recycle stream 100 from the boil-off of the oxygen-enriched kettle stream. Liquid nitrogen stream 82 could be added to the liquid nitrogen reflux stream 81 that is used to reflux the lower pressure column 74.

The remaining portion of the oxygen-enriched kettle stream, referred to as the second split portion 87, is subcooled and then flashed via valve 187 and introduced into an intermediate location of the lower pressure column 74, a number of stages above the first main condenser-reboiler 75. In addition, a third portion of the nitrogen-rich vapor column overhead extracted from the higher pressure column 72 which is not liquefied in either of the first main condenser-reboiler or the second condenser-reboiler but is withdrawn as a high pressure nitrogen product stream 105 and warmed in heat exchangers 52A and 52B to produce a warmed high pressure nitrogen product stream 115.

In the lower pressure column 74, the ascending vapor phase includes the boil-off from the first main condenser-reboiler 75 as well as the exhaust stream 64 from the upper column turbine 35 introduced at an intermediate location of the lower pressure column 74. The descending liquid is initiated by nitrogen reflux stream 96 from the third condenser reboiler 95 which is released into the lower pressure column 74.

Lower pressure column 74 is also provided with a plurality of mass transfer contacting elements, that can be trays or structured packing or other known elements in the art of cryogenic air separation. The separation occurring within lower pressure column 74 produces a nitrogen overhead 92, a lower pressure nitrogen product stream 110 taken from a location proximate an upper section of the lower pressure column several stages below the overhead 92, and an oxygen-rich liquid column bottoms 77. The lower pressure nitrogen product stream 110 is further warmed in heat exchangers 52B, 52A to produce a lower pressure, warmed nitrogen product stream 120.

As indicated above, the third condenser-reboiler 95 is associated with the lower pressure column 74 and disposed in a vessel 94. The third condenser-reboiler 95 is configured to condense the nitrogen overhead 92 from the lower pressure column 74 against the portion of the oxygen bottoms liquid 77 that is not reboiled. That portion of the oxygen bottoms liquid 77 from the lower pressure column 74 is subcooled and the subcooled stream 176 is flashed via valve 177 with the resulting stream 178 into the boiling side of the third condenser-reboiler 95. The condensed liquid produced by the third condenser-reboiler 95 is nitrogen reflux stream 96 used to reflux the lower pressure column 74 while the vapor generated is withdrawn as waste stream 93 which is warmed in heat exchanger 52B and the warmed waste stream 193 may be utilized to regenerate the pre-purifier unit 28.

The recycle stream 100 is taken from the vapor stream exiting the second condenser-reboiler 85 and is preferably recycled back to the main air compression system and combined with the incoming feed air stream 22. As shown in FIG. 1, the heat exchangers 52A and 52B are configured to extract refrigeration from the recycle stream 100 and cool the compressed, purified air in part via indirect heat exchange with the recycle stream 100. The warmed recycle stream 102 is then introduced to the main air compressor 24, preferably at an inter-stage location, or optionally compressed in a recycle compressor (not shown) and cooled in an aftercooler (not shown) prior to combining with the feed air stream.

Figure 2:
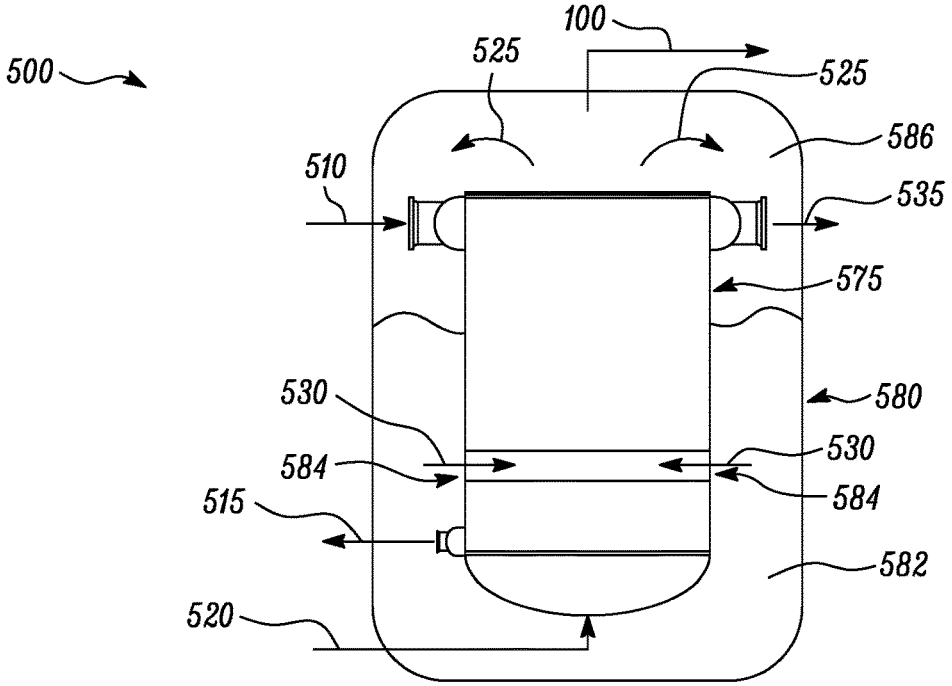
FIG. 2 is a schematic illustration depicting the two condenser-reboilers associated with the high pressure column combined into a single heat exchanger.

To reduce the capital costs associated with the illustrated dual column, nitrogen producing cryogenic air separation unit, it is contemplated to combine or integrate the first main condenser-reboiler 75 and the second condenser-reboiler 85 may be combined or integrated into a single structure or a single heat exchanger arrangement. FIG. 2 shows one such contemplated embodiment that provides a single heat exchanger design with separate boiling passages for the split kettle streams. The disclosed embodiment includes an inner condenser reboiler 575 disposed within an outer phase separator 580. The combined arrangement 500 may be disposed within a separate vessel or may be integrated with the lower pressure column.

Gaseous nitrogen stream 510 is fed near the top of the once-through inner condenser-reboiler 575 where it is condensed against the split kettle streams to produce a liquid nitrogen stream 515 that exits the bottom section of the inner condenser-reboiler 575. The split kettle streams preferably comprise a first kettle stream 520 and a second kettle stream 530. First kettle stream 520 is fed into the bottom portion of inner condenser-reboiler 575 and the resulting boil-off of the first kettle stream 520 is a two phase stream 525 that is released into the outer phase separator 580. The liquid portion 582 of the first kettle stream boil-off from the phase separator 580 is reintroduced via a nozzle 584 into separate heat exchange passages of the inner condenser-reboiler 575 as second kettle stream 530. The vapor portion 586 of the first kettle stream boil-off exits from the top section of the phase separator 580 as recycle stream 100. The second kettle stream 530 is introduced into the inner condenser-reboiler 575 at an intermediate location and boils to produce a second kettle boil off that is drawn from the inner condenser-reboiler 575 as stream 535, but not mixed with the recycle stream 100. The introduction of the second kettle stream 530 into the inner condenser-reboiler 575 is at a relatively higher location compared to the introduction of the first kettle stream via feed nozzle 524 proximate the cold end of the inner condenser-reboiler 575. A potential advantage of the elevated nozzle is that second kettle stream is introduced at a slightly warm temperature due to the enriched oxygen concentration and therefore a higher feed location would provide better a match with the heat exchanger axial temperature profile.

Figure 3:
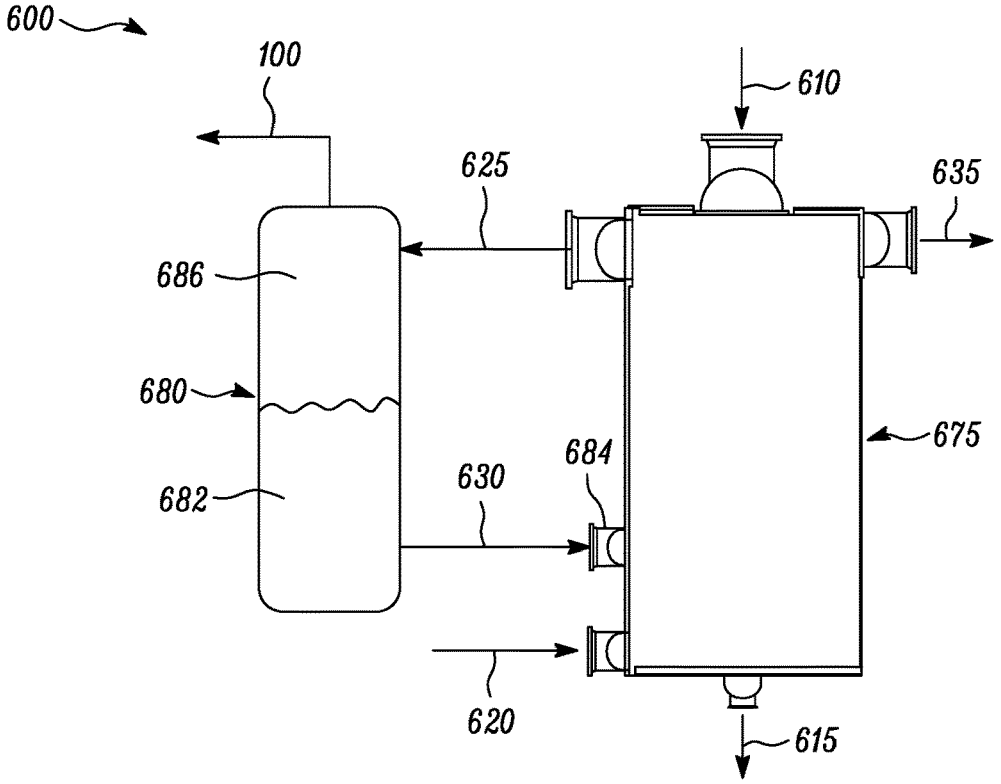
FIG. 3 is a schematic illustration of an alternate embodiment depicting the two condenser-reboilers associated with the high pressure column combined into a single heat exchanger with a phase separator.

FIG. 3 shows an alternate embodiment of the combined condenser-reboiler arrangement 600. This embodiment includes a condenser reboiler 675 disposed adjacent to an external phase separator 680. Similar to the embodiment described above with reference to FIG. 2, a gaseous nitrogen stream 610 is fed at the top of the combined condenser-reboiler 675 shown in FIG. 3 where it is condensed against the split kettle streams to produce a liquid nitrogen stream 615 that exits the bottom of the combined condenser-reboiler 675. The split kettle streams preferably comprise a first kettle stream 620 and a second kettle stream 630. First kettle stream 620 is fed into the bottom portion of combined condenser-reboiler 675 and the resulting boil-off of the first kettle stream is withdrawn as a two phase stream 625 that is directed to an external phase separator 680 which separates the liquid phase from the gaseous phase. The vapor portion 686 exits from the top section of the phase separator 680 as recycle stream 100 while the liquid portion 682 is reintroduced via a nozzle 684 into separate heat exchange passages of the combined condenser-reboiler 675 as second kettle stream. The second kettle stream 630 is introduced into the inner condenser-reboiler 675 at a vertically higher (i.e. warmer) location and boils to produce a second kettle boil off that is drawn from the combined condenser-reboiler 675 as stream 635.

While the present enhancements to a large-scale, dual column nitrogen producing air separation unit has been described with reference to several preferred embodiments, it is understood that numerous additions, changes and omissions can be made without departing from the spirit and scope of the present inventions as set forth in the appended claims.

What is claimed is:

1. An integrated condenser-reboiler arrangement for a distillation column system comprising:

a phase separator; and a once-through condenser-reboiler disposed within the phase separator, the once-through condenser-reboiler having a top section, an intermediate location, and a bottom section;

a plurality of condensing passages configured to receive a gaseous stream from the distillation column system at the top section of the once-through condenser-reboiler and condense the gaseous stream traversing through the plurality of condensing passages via indirect heat exchange with a first kettle stream and a second kettle stream to yield a condensate that exits the bottom section of the once-through condenser-reboiler;

a first set of boiling passages configured to receive the first kettle stream from the distillation column system at the bottom section of the once-through condenser-reboiler and partially vaporize the first condensing stream via indirect heat exchange with the gaseous stream traversing through the cooling passages to yield a dual phase boil off stream, and wherein the dual phase boil off stream is released from the top section of the once-through condenser-reboiler into the phase separator;

a second set of boiling passages configured to receive the second condensing medium from the phase separator at an intermediate location on the once-through condenser-reboiler and vaporize or partially vaporize the second condensing medium to yield another boil off stream that exits the top section of the once-through condenser-reboiler and directed back to the distillation column system;

wherein the phase separator is configured to separate the dual phase boil off stream into the second condensing medium and a recycle vapor stream.

2. The integrated condenser-reboiler arrangement of claim 1 wherein the recycle vapor stream is directed back to the distillation column system.

3. The integrated condenser-reboiler arrangement of claim 1 wherein the recycle vapor stream is directed back to a main heat exchanger associated with the distillation column system.

4. The integrated condenser-reboiler arrangement of claim 1 wherein the gaseous stream is a nitrogen enriched stream received from the distillation column system.

5. The integrated condenser-reboiler arrangement of claim 1, wherein the integrated condenser-reboiler arrangement is disposed within a distillation column within the distillation column system.

6. The integrated condenser-reboiler arrangement of claim 1, wherein the first kettle stream is a first portion of an oxygen enriched kettle stream received from the distillation column system and the second kettle stream from the distillation column system is directed to the phase separator vessel.

7. An integrated condenser-reboiler arrangement for a distillation column system comprising:

a phase separator;

a once-through condenser-reboiler in fluid communication with the phase separator, the once-through condenser-reboiler comprising:

a top section, an intermediate location, and a bottom section a plurality of condensing passages configured to receive a gaseous stream from the distillation column system at the top section of the once-through condenser-reboiler and condense the gaseous stream traversing through the plurality of condensing passages via indirect heat exchange with a first kettle stream and a second kettle stream to yield a condensate that exits the bottom section of the once-through condenser-reboiler;

a first set of boiling passages configured to receive the first kettle stream from the distillation column system at the bottom section of the once-through condenser-reboiler and partially vaporize the first condensing stream via indirect heat exchange with the gaseous stream traversing through the cooling passages to yield a dual phase boil off stream, and wherein the dual phase boil off stream is released from the top section of the once-through condenser-reboiler into the phase separator;

a second set of boiling passages configured to receive the second condensing medium from the phase separator at an intermediate location on the once-through condenser-reboiler and vaporize or partially vaporize the second condensing medium to yield another boil off stream that exits the top section of the once-through condenser-reboiler and directed back to the distillation column system;

wherein the phase separator is configured to separate the dual phase boil off stream into the second condensing medium and a recycle vapor stream.

8. The integrated condenser-reboiler arrangement of claim 7 wherein the recycle vapor stream is directed back to the distillation column system.

9. The integrated condenser-reboiler arrangement of claim 7 wherein the recycle vapor stream is directed back to a main heat exchanger associated with the distillation column system.

10. The integrated condenser-reboiler arrangement of claim 7 wherein the gaseous stream is a nitrogen enriched stream received from the distillation column system.

11. The integrated condenser-reboiler arrangement of claim 7, wherein the first kettle stream is a first portion of an oxygen enriched kettle stream received from the distillation column system and the second kettle stream from the distillation column system is directed to the phase separator vessel.

* * * * *